US007004714B2

(12) United States Patent
Bagni

(10) Patent No.: US 7,004,714 B2
(45) Date of Patent: Feb. 28, 2006

(54) METHOD AND APPARATUS FOR AUTOMATICALLY LOADING SOCKS, KNEE SOCKS AND THE LIKE ONTO FORMS

(75) Inventor: Gianfranco Bagni, Ghedi (IT)

(73) Assignee: Santoni S.p.A., (IT)

( * ) Notice: Subject to any disclaimer, the term of this patent is extended or adjusted under 35 U.S.C. 154(b) by 0 days.

(21) Appl. No.: 10/201,235

(22) Filed: Jul. 22, 2002

(65) Prior Publication Data

US 2003/0015398 A1 Jan. 23, 2003

(30) Foreign Application Priority Data

Jul. 20, 2001 (IT) ..... PI2001A0054

(51) Int. Cl.
*B25J 5/00* (2006.01)

(52) U.S. Cl. ..... 414/729; 38/7; 198/409; 223/75; 294/93; 414/783

(58) Field of Classification Search ..... 414/13, 414/680, 729, 783; 901/17; 198/409; 294/93; 38/7; 223/75, 76, 77
See application file for complete search history.

(56) References Cited

U.S. PATENT DOCUMENTS 2,792,953 A * 5/1957 King ..... 414/728
6,138,818 A * 10/2000 Green ..... 198/373
6,761,527 B1 * 7/2004 Eisenzimmer et al. ..... 414/758

FOREIGN PATENT DOCUMENTS

EP 0878573 A2 11/1998
WO WO02/18639 A1 3/2002

* cited by examiner

*Primary Examiner*—Donald W. Underwood
(74) *Attorney, Agent, or Firm*—The Bilicki Law Firm, P.C.

(57) ABSTRACT

An apparatus for automatically loading socks on forms (1) comprises a suction unit (20) at an inlet, a carousel (10) with several stations (2, 3, 4, 5), a positioning unit (30) of the sock (S), a tucking-up unit (40) and a pick-up robot (50). The carousel has intermediate supports (12) onto which can be put, partially or completely, the socks (S). The carousel (10) brings the intermediate supports (12) through successive stations (2, 3, 4, 5) up to a pick-up station (5), where an arm (52) is connected pivotally (55*a*) to a carriage sliding on an upright (53). Means are provided for translating (53*a*) vertically the carriage vertically upwards or downwards, along the upright (53), and for rotating (55*a*) integrally the arm (52) about said horizontal axis (55). Pick-up fingers (56) are provided at a first end (52*b*) of said arm (52) associated to means for opening (56*a*) and closing them. The arm is movable between at least a first and a second position; in the first position the fingers (56) are oriented downward and capable of entering through the band portion between the sock (S) and an intermediate support (12) onto whose the sock (S) is put with tip portion orientated downward; in the second position the pick-up fingers (56) are oriented upward and capable of placing the sock (S) with tip portion towards the above on a steaming form (6) oriented upwards.

3 Claims, 2 Drawing Sheets

METHOD AND APPARATUS FOR AUTOMATICALLY LOADING SOCKS, KNEE SOCKS AND THE LIKE ONTO FORMS

FIELD OF THE INVENTION

The present invention relates to an apparatus for automatically loading hosiery articles, such as socks, knee socks, and the like, onto forms. Furthermore, the invention relates to a method for automatically loading hosiery articles, such as socks, knee socks, and the like, onto forms. The method is used, for example, in automatic steaming lines of such articles.

In the following description, reference is made to loading socks onto forms, being it clear that the same concept can be extended to loading knee socks and other similar articles for which an orientation is necessary before the loading step onto the forms.

SUMMARY OF THE INVENTION

It is an object of the present invention to provide an apparatus for loading socks and knee socks on a steaming machine that minimizes the diameter and reduces the complexity of the carousel and the loading robot.

It is, furthermore, an object of the present invention to provide a method for loading socks and knee socks on a steaming machine that minimizes the diameter and reduces the complexity of the carousel and the loading robot.

According to a main aspect of the invention, after a suction step, the socks are loaded on intermediate supports of elongated shape making part of a positioning carousel with several stations, at least one of which is a station of axial positioning of the sock, and at least one of which is a station of loading/unloading the sock.

The characteristic of the invention is that at unloading from the positioning carousel, the sock is arranged on the relative intermediate support with the tip portion of the sock oriented downward. Then, with a single movement that follows a predetermined trajectory, the sock is drawn and placed on a steaming form with the tip portion oriented upwards. In this way, rotation of the intermediate supports is not necessary, so that the intermediate supports can be fixed and always oriented downward on all the stations of the carousel.

The pick-up step of the sock from the intermediate support and its loading onto the steaming forms is carried out in a corresponding station by means of an equipment formed by at least an arm that can: translate vertically upwards or downwards along an upright; rotate integrally about an horizontal axis at an end thereof; and open and stop pick-up fingers at the other end thereof.

The pick-up fingers are oriented downward and, while closed, enter into the grooves provided between the sock and the intermediate support, thereby entering the sock through the band portion. Then, the pick-up fingers open wide and the arm is lowered, drawing the opened sock away from the support. The open pick-up fingers keep the sock stretched and enlarged with the tip portion oriented downward, even when the sock is completely extracted from the support by translating the arm. Then, the arm rotates substantially semicircular with respect to an horizontal axis orthogonal to the plane of movement of the arm, so that the sock's tip portion is oriented upward and band portion is oriented downward, and so that the sock is loaded with the same rotation onto the steaming form. Once the sock has been put on the form, the arm continues its rotation and the pick-up fingers, while oriented upward, are closed and drawn away from the band portion. Then, after the arm is rotated so that the pick-up fingers are oriented downward, the arm returns to repeat the pick-up step.

DESCRIPTION OF THE DRAWINGS

Further characteristics and advantages of the apparatus and method according to the present invention, for opening, positioning and loading socks, knee socks and the like onto forms, will be made clearer with the following description of an embodiment thereof, exemplifying but not limiting, with reference to attached drawings wherein.

DESCRIPTION OF THE PREFERRED EMBODIMENT

Figure 1:
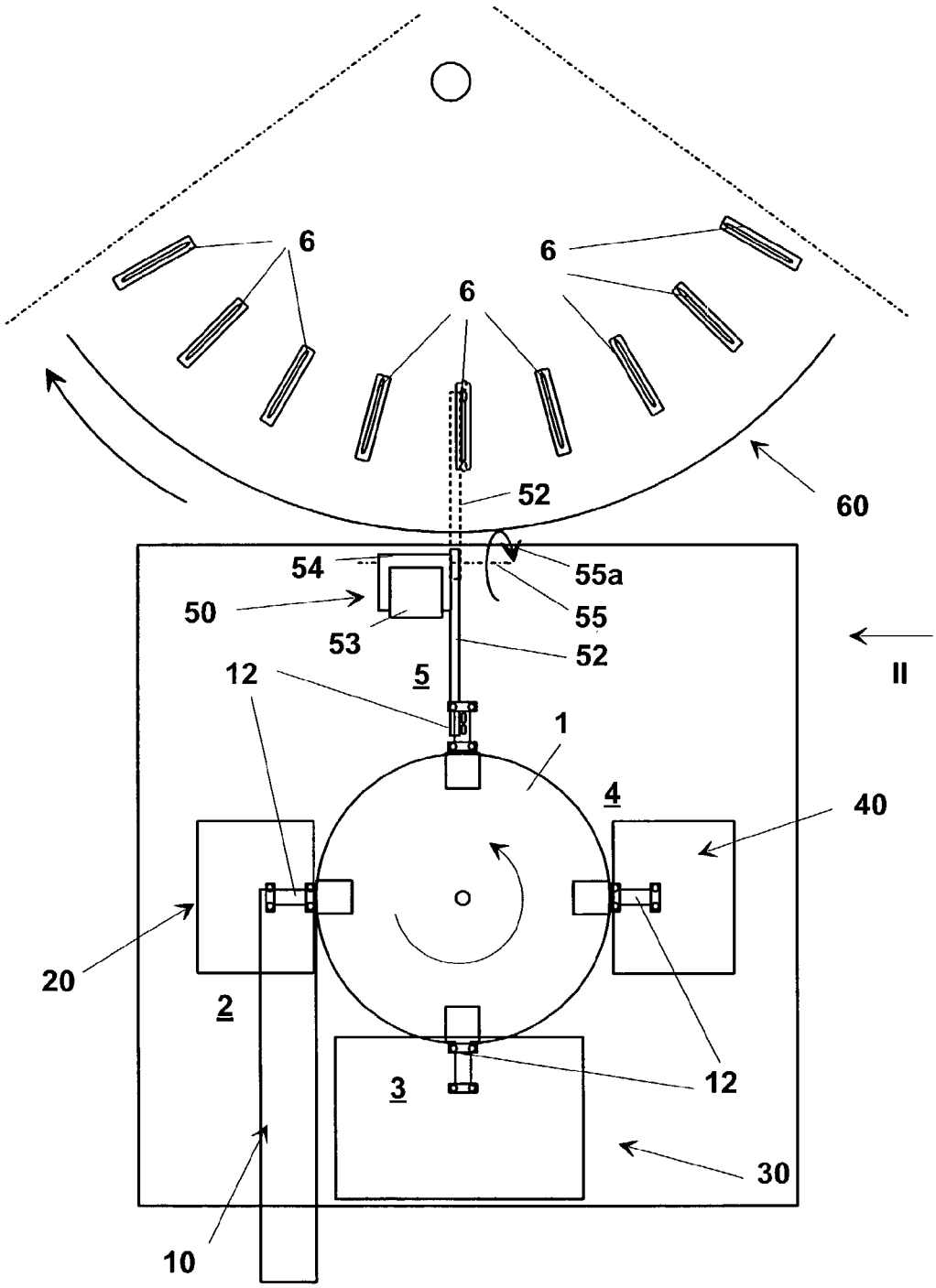
FIG. 1 shows a top plan view of an apparatus according to the invention with four stations of pick up and loading socks arranged on a steaming machine.

With reference to FIG. 1, an apparatus for automatically loading socks comprises suction unit 10 as an inlet and carousel 1 with four stations. The four stations include loading unit 20, where the socks are loaded onto intermediate supports 12, which are integral to carousel 1; positioning unit 30; tucking-up unit 40; Robot 50 for picking up the socks from intermediate supports 12 and positioning them on forms 6 of steaming apparatus 60.

More precisely, carousel 1 has four intermediate supports 12 onto which socks can be placed, partially or completely. Intermediate supports 12 are fixed with respect to carousel 1 and oriented downward. They rotate integrally with carousel 1 through four successive stations; loading station at inlet 2, positioning station 3, tucking-up station 4, and pick-up station 5, respectively.

In the loading station at inlet 2, a sock (not shown) is dragged by suction unit 10 and presented, with the band portion oriented forward, to loading unit 20, which opens the sock in a known way and puts it on intermediate support 12, also present in loading station 2.

In positioning station 3, one example of positioning unit 30 is described in WO0218696, in the name of the same applicant. In positioning unit 30, a sock is orientated so that the tip portion of the sock is in the plane of intermediate support 12. Intermediate support 12 has longitudinal edges that are cylindrical, in order to make circular sliding and positioning of the sock easier by means of friction rollers, for example. One of ordinary skill in the art can carry out the positioning by the teachings of WO0218696.

After positioning station 3, the socks are "tucked up" in station 40, i.e. put further onto intermediate supports 12 so that the tip portion of the sock fits almost completely on intermediate supports 12. To this end, tucking-up unit 40 is provided. Tucking-up unit 40 is not described in detail, however, since such a unit is known to a person ordinarily skilled in the art of hosiery machines.

At the moment of unloading from carousel 1, the sock is arranged on intermediate support 12 always with the tip portion oriented downward and almost completely tucked up on intermediate support 12. Pick-up unit 50 draws the sock away from intermediate support 12 and places the sock on steaming form 6, with the tip portion oriented upward, with a single movement that follows predetermined trajectory 51 (FIG. 2).

Figure 2:
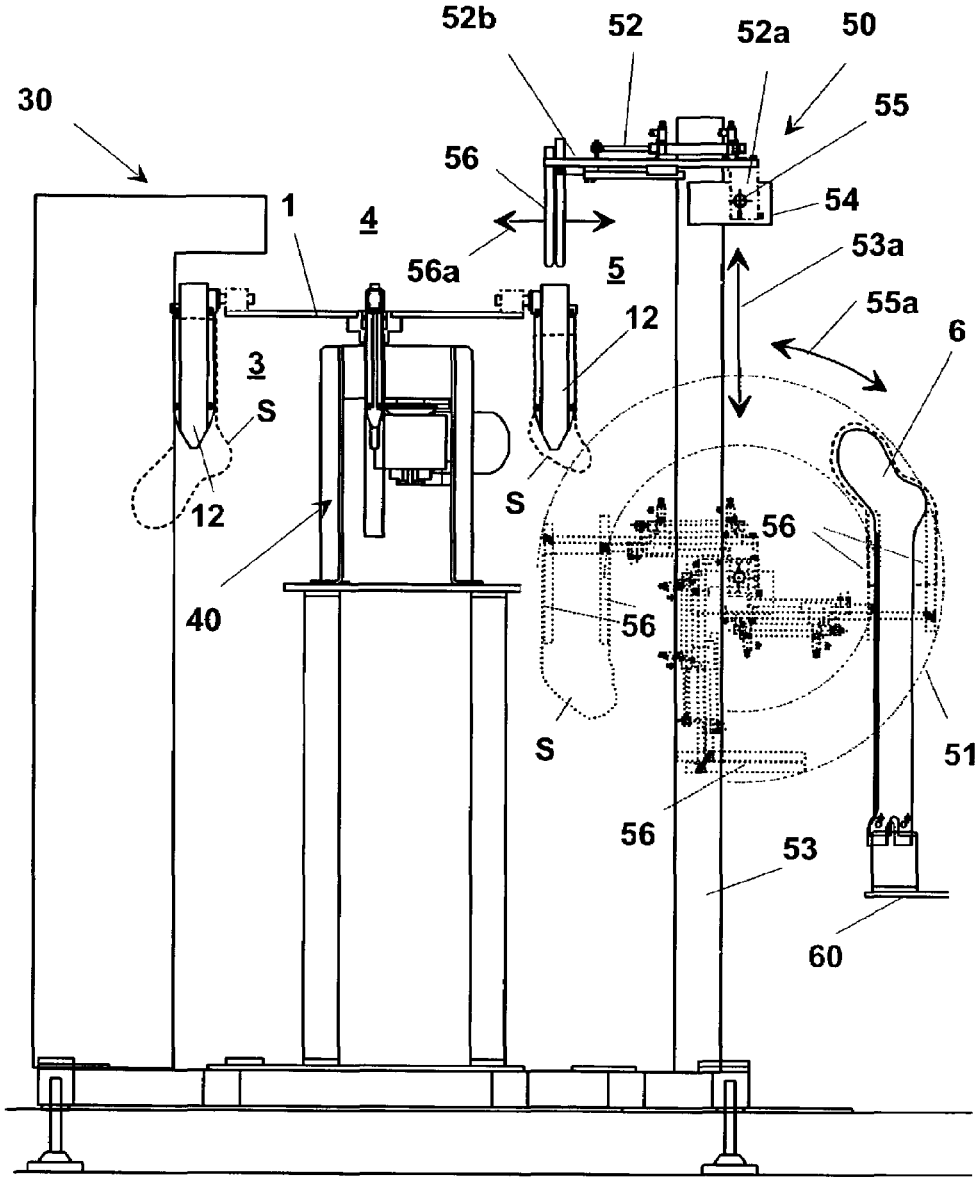
FIG. 2 shows an elevational view of the machine of FIG. 1 according to arrow II of FIG. 1.

Pick-up unit 50, as shown in FIG. 2, comprises arm 52 that can: translate vertically, according to arrow 53*a*, upwards or downwards along upright 53 on carriage 54; rotate integrally about horizontal axis 55 at first end 52*a*, according to arrow 55*a*; and open and stop picking-up fingers 56 at second end 52*b*, according to arrows 56*a*. Arm 52 is connected pivotally to carriage 54.

Rotation 55*a* is substantially semicircular with respect to horizontal axis 55 and is carried out in a vertical plane containing shape 6 and intermediate support 12.

Pick-up fingers 56 are oriented downward at first and enter between sock S and intermediate support 12, entering sock S through its band portion. Then, pick-up fingers 56 open wide and arm 52 is lowered drawing sock S from intermediate support 12.

Pick-up fingers 56 keep sock S stretched and open with the tip portion oriented downward, completely extracted from intermediate support 12. Then, arm 52 carries out a semicircular rotation 51 with respect to its horizontal axis 55 so that sock S has its tip portion orientated upwards and band portion oriented downward, and so that sock S is loaded on steaming form 6 with the same rotation. Once sock S has been put on shape 6, arm 52 continues its rotation and pick-up fingers 56 are closed and drawn away from the band portion of sock S. Then, arm 52 is returned up to repeat the pick-up step.

This movement can be made either rotating back, up to the starting angle, or rotating forward, up to rotating 360°, with respect to the starting position.

The back stroke rotation is carried out at a height on the upright that does not obstruct neighboring apparatus.

The opening/closing movement of pick-up fingers 56, the upwards/downwards movement of carriage 53, and the rotation of arm 52 about axis 55 are made by means for opening, translating, and rotating, respectively. These means constitute actuators available on the market and can be easily mounted by a man ordinarily skilled in the art.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realize the different functions described herein could have a different nature without, for this reason, departing from the field of the invention. It is to be understood that the phraseology or terminology employed herein is for the purpose of description and not of limitation.

What is claimed is:

1. An apparatus for loading socks (S) on a steaming machine (60), said socks (S) being previously put on intermediate supports (12) of elongated shape and making part of a positioning carousel (1) with several stations (2, 3, 4, 5), said socks (S) being brought selectively in an unloading station (5) on an intermediate support (12) with tip portion oriented downward, comprising:

a rotatable arm (52) mounted (55*a*) about an horizontal axis (55) of said steaming machine (60);

a carriage sliding on an upright (53) and carrying said arm (52) and said horizontal axis (55*a*)

means for vertically translating (53*a*) said carriage upwards or downwards along the upright (53);

means for rotating (55*a*) said arm (52) about said horizontal axis (55);

pick-up fingers (56) provided at one end of said arm (52) said pick-up fingers adapted to grasp said socks (S);

means for opening, closing (56*a*), and stopping said pick-up fingers (56).

2. The apparatus of claim 1, wherein said arm mounted about a horizontal axis on said carriage (54) sliding on said upright (53) is rotatable between at least a first and a second position, in said first position said pick-up fingers (56) being oriented downward and being capable of entering between the sock (S) and an intermediate support (12) onto which the sock (S) is put with tip portion downward, entering the sock (S) through the band portion, whereas in said second position said pick-up fingers (56) are oriented upward and capable of placing said sock (S) with tip portion upward on a steaming form (6) oriented upwards.

3. The apparatus of claim 1, wherein said means for rotating cause said arm (52) to rotate (55*a*) substantially semicircular with respect to said horizontal axis (55) in a vertical plane.

* * * * *